US005911417A

United States Patent [19]

Lin

[11] Patent Number: 5,911,417

[45] Date of Patent: Jun. 15, 1999

[54] SHEET JAMMING-PROOF MECHANISM FOR PAPER-FEEDING SYSTEM

[75] Inventor: John Lin, Hsin-Chu, Taiwan

[73] Assignee: Mustek Systems, Inc., Hsin-Chu, Taiwan

[21] Appl. No.: 08/866,328

[22] Filed: May 30, 1997

[51] Int. Cl.[6] ..... B65H 7/02

[52] U.S. Cl. ..... 271/228; 271/240; 271/248; 271/265.01; 271/265.02; 271/902; 271/261

[58] Field of Search ..... 271/227, 228, 271/240, 248, 258.01, 259, 261, 265.02, 265.03, 902, 176

[56] References Cited

U.S. PATENT DOCUMENTS

| | | | |
|---|---|---|---|
| 5,091,754 | 2/1992 | Abe et al. | 271/240 |
| 5,110,106 | 5/1992 | Matsumura et al. | 271/171 |

FOREIGN PATENT DOCUMENTS

| | | | |
|---|---|---|---|
| 0140445 | 11/1980 | Japan | 271/261 |
| 403177245 | 8/1991 | Japan | 271/240 |
| 403211147 | 9/1991 | Japan | 271/259 |
| 404113876 | 4/1992 | Japan | 271/227 |
| 406016248 | 1/1994 | Japan | 271/240 |

*Primary Examiner*—H. Grant Skaggs
*Attorney, Agent, or Firm*—Bacon & Thomas

[57] ABSTRACT

A sheet jamming-proof mechanism for a paper-feeding system provided outside of a left and a right paper boundaries delimited along a predetermined paper-feeding pathway to supervise the paper-feeding direction for preventing sheet jamming. The sheet jamming-proof mechanism includes: a plurality of touch plates, each touch plate being closely contiguous to the outside of the left or right boundary of paper-feeding pathway and being elastically hold by the paper-feeding system so that the touch plate is forced to shift when the contact plate is pressed by a deviated paper; a plurality of detectors, each detector locates in the vicinity of the touch plate to sense the shift of the touch plate; and a controller which controls the driving device of the paper-feeding system to alter the ordinary paper-feeding operation for preventing sheet jamming when shift of any touch plate is sensed by the detectors.

10 Claims, 10 Drawing Sheets

SHEET JAMMING-PROOF MECHANISM FOR PAPER-FEEDING SYSTEM

BACKGROUND OF THE INVENTION

1. Field of the Invention

The invention relates to a sheet jamming-proof mechanism in a paper-feeding system, and more particularly, to a sheet jamming-proof mechanism for an image scanner.

2. Description of the Related Art

The paper-feeding system has been widely used in various machines such as scanner, photocopier, printer, and fax machine. Sheet jamming can be caused by aging of equipment or improper operation of a paper-feeding system. However, neither a sheet jamming-proof mechanism nor a fault-eliminating apparatus designed for helping users when sheet jamming occurred is seen in the typical paper-feeding systems. As sheet jamming occurs, the user practiced in the machine usually opens the cover of machine and pulls the jammed paper out, which causes a relatively serious attrition to the machine. For those who are not familiar to the operation of the machine, it is even impossible to take out the jammed paper without asking somebody else for help.

To solve the aforesaid problems, in Taiwanese Patent Application Ser. No. 85207086 (Patent Publication No. 291219) is disclosed a "scanning device having drawer cassette", by which jammed paper can be quickly eliminated by pulling the drawer cassette out when sheet jamming happens. Referring to FIG. 1A and 1B, there are shown the exploded perspective views of this scanning device which includes: a housing 2, a motor and reducing gear train I received within the housing 2, a drawer cassette 3, and a reflecting mirror 4. In the front panel of housing 2 are provided with a drawer cassette eject key 5, a document backward key 6, a document forward key 7, and a LED indicator 8. The drawer cassette 3, installed on slide guide 10 in housing 2 and being able to be drawn out from the housing, consists: a document inlet 31, a timing belt 32, a gear 33, a drawer cassette side flange 34, a document exit cover 35, a drawer cassette anchoring hole 36, a roller suite 37, a scanning window 38, a connecting rod 39 for anchoring drawer cassette, a pushing rod 310, a guiding groove 311, and a stopping spring 312.

When a document is jammed within the scanning passage, the user may press eject key 5 to slightly eject drawer cassette 3 by the tension of spring 312, glide the drawer cassette 3 out from slide guide 10, open document exit cover 35, and then take the jammed document out easily.

Also disclosed in Taiwanese Patent Application Ser. No. 84213349 (Patent Publication No. 282196) is a "Drawer type scanner structure integrated in a computer mainframe". The scanner provides a similar function for solving the sheet jamming problem. FIG. 2A and 2B show the exploded perspective views of the related scanner, wherein FIG. 2A shows the spatial positioning structure 100 of the scanner including: a main case 46, a bottom 41, a scanner case 42, an elastic locking member 43, a spring 44, a top cover 45, a first mounting seat 47, a second mounting seat 48, a locking portion 49, a lifting part 410, a roller 411, a rib 412, a restricting groove 413, a stopping portion 414, a panel 424, a feeding roller 421 which is provided within the scanner case 42, and a rail 415 provided on the inner surface of main case, each rail 415 consists a groove 416, while top cover 45 has two openings 423.

When sheet jamming occurs, the user first pushes scanner case 42 to move it toward locking member 43, then locking portion 49 is released from locking member 43 by the attribute of locking member 43 and scanner case 42 is protruded to expose outside the surface of the mainframe case (not shown). Thereby the user can raise the lifting part 410 of top cover 45 to remove the jammed document.

As described above, the sheet jamming problem can be solved by means of the aforesaid prior art. However, if we can detect and eliminate the sheet jamming at the very beginning when the document deviates from the predetermined direction, then the attrition to the machine can be reduced and the structure of the machine can be greatly simplified.

Therefore, an object of the invention is to provide a simply constructed sheet jamming-proof mechanism for paper-feeding system which can be applied to all machinery having paper-feeding system without limiting to a scanning apparatus.

SUMMARY OF THE INVENTION

According to the invention, a sheet jamming-proof mechanism for a paper-feeding system is provided outside of a left and a right paper boundaries delimited along a predetermined paper-feeding pathway to supervise the paper-feeding direction and, when the paper-feeding direction deviates from the predetermined pathway, to alter the ordinary paper-feeding operation by controlling the driving device of the paper-feeding system for preventing sheet jamming. The sheet jamming-proof mechanism for paper-feeding system includes: a set of touch plates containing at least one touch plate, each of the touch plate being closely contiguous to the outside of left or right boundary of paper-feeding pathway and being elastically hold by the frame of the paper-feeding system, the touch plate is forced to shift toward the boundaries when pressed by a deviated paper; a set of detectors containing at least one detector, each of the detector being located in the vicinity of the touch plate for sensing the shift of the touch plate; and a controller adapted to control the driving device of the paper-feeding system to alter the ordinary paper-feeding operation for preventing sheet jamming when shift of any touch plate is sensed by the detectors.

DESCRIPTION OF THE PREFERRED EMBODIMENTS

Figure 1A:
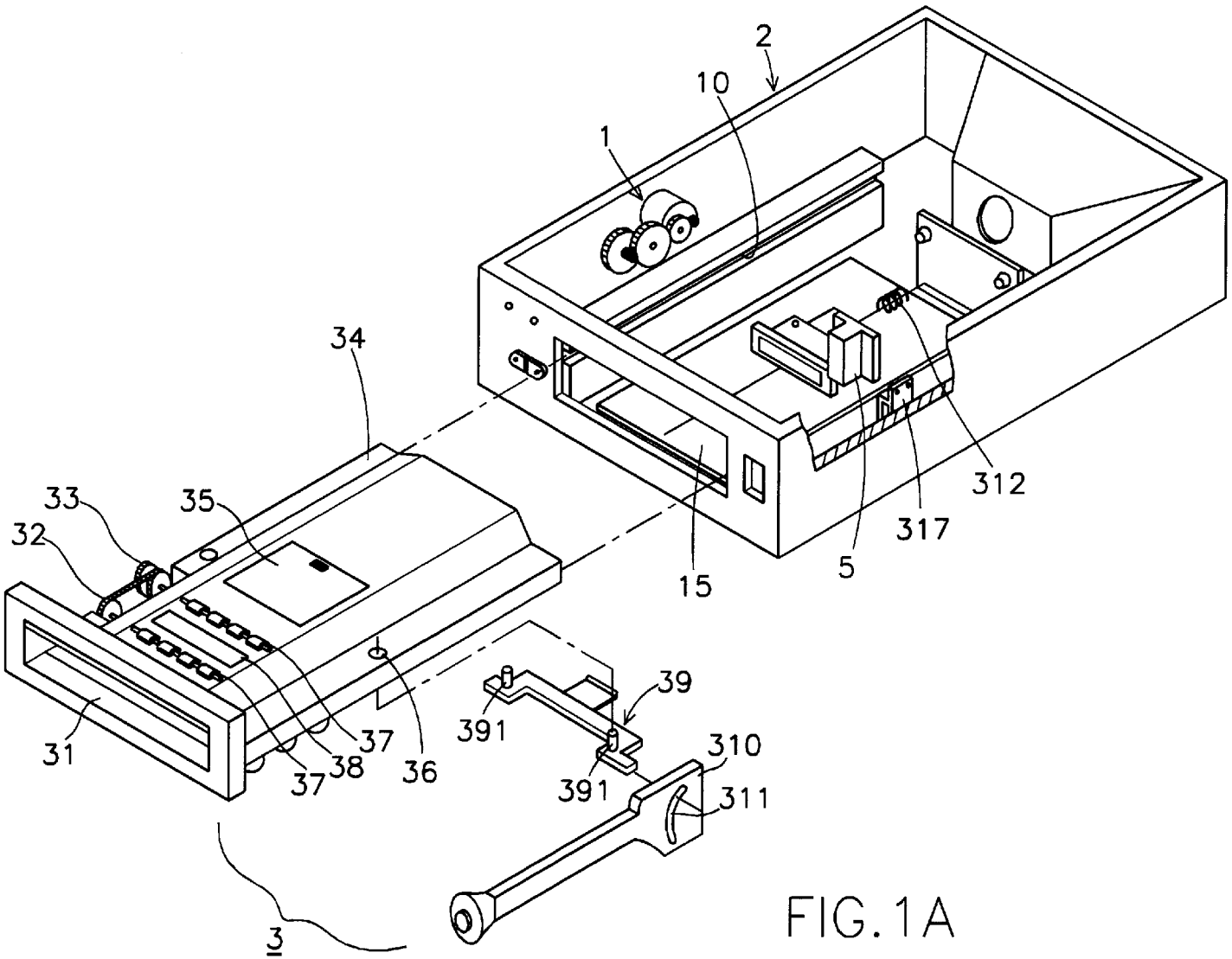
FIG. 1A and 1B are the exploded perspective views showing a prior scanning apparatus having sheet jamming-eliminating function.
Figure 1B:
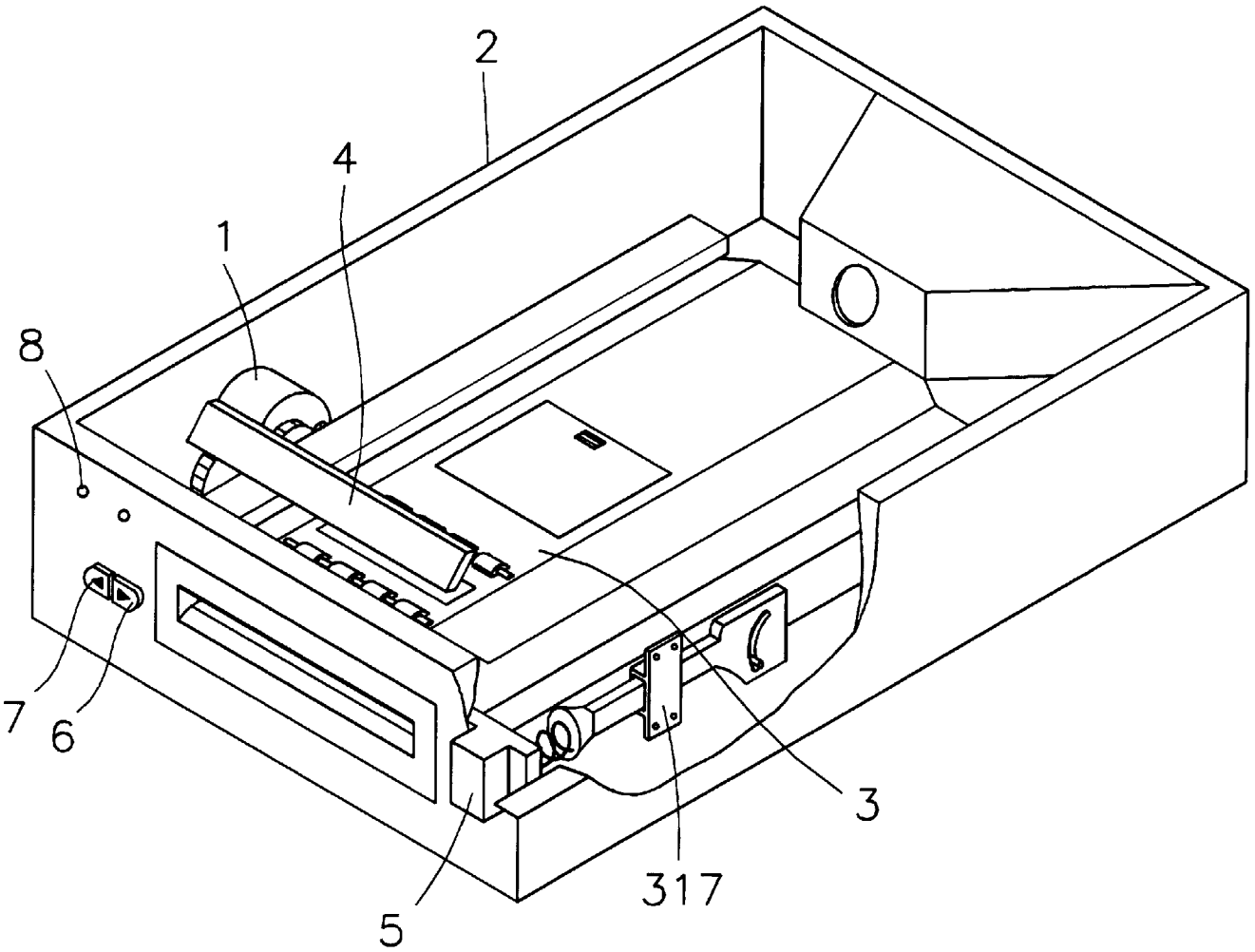
Figure 2A:
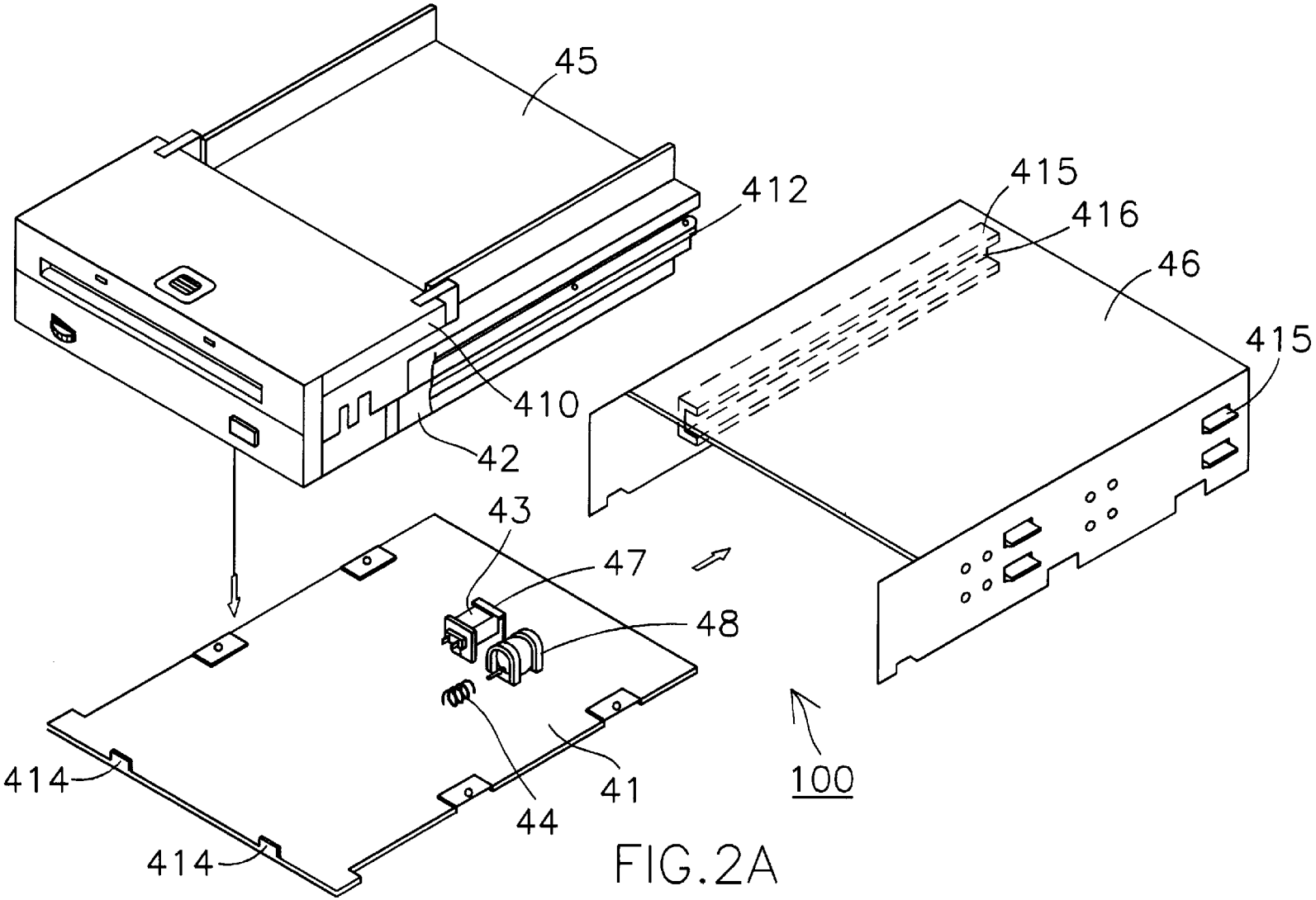
FIG. 2A and 2B are the exploded perspective views showing another prior scanning apparatus having sheet jamming-elimination function.
Figure 2B:
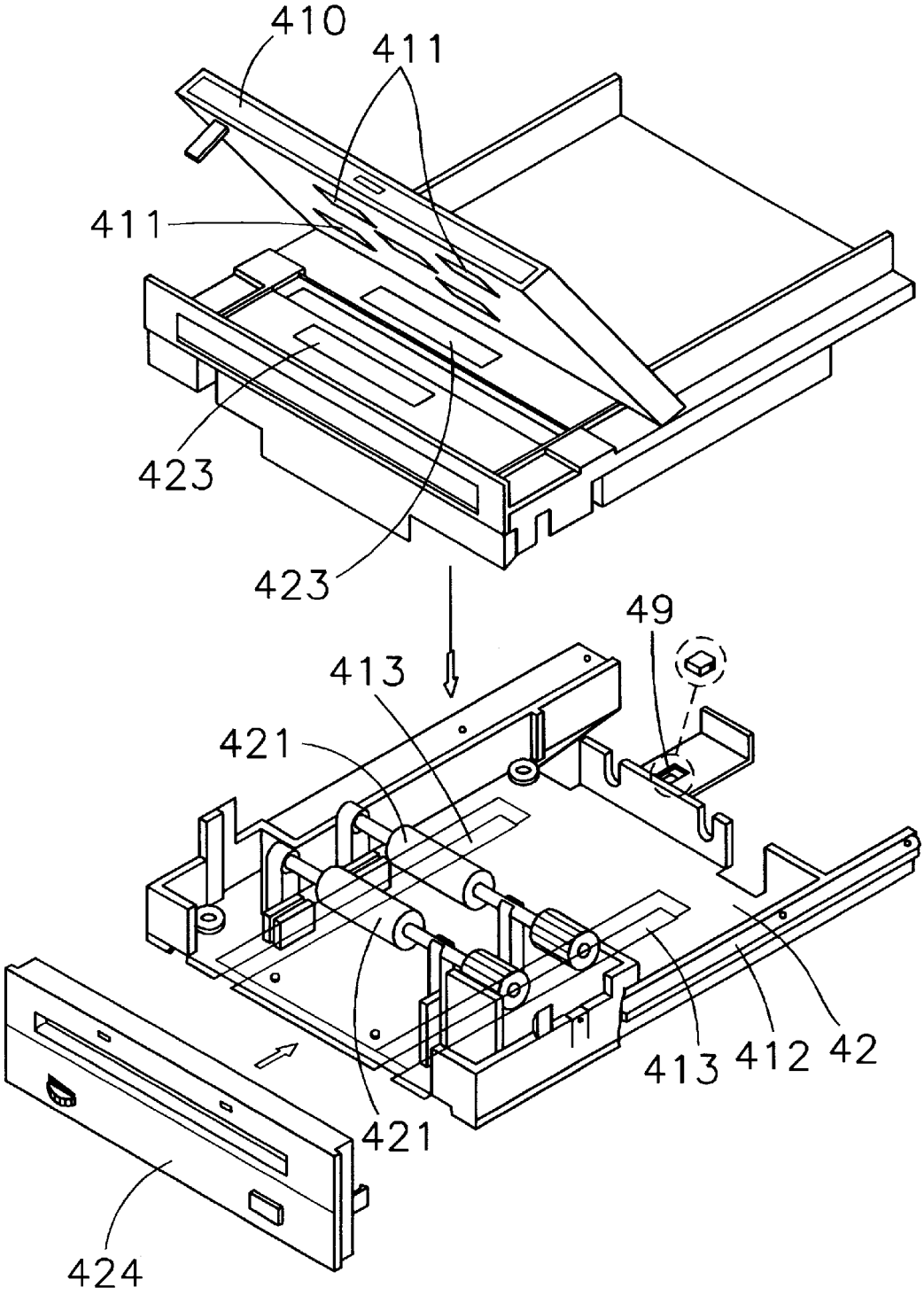

The structure of the sheet jamming-proof mechanism for paper-feeding system according to the invention is described hereinafter referring to the drawings.

Figure 3A:
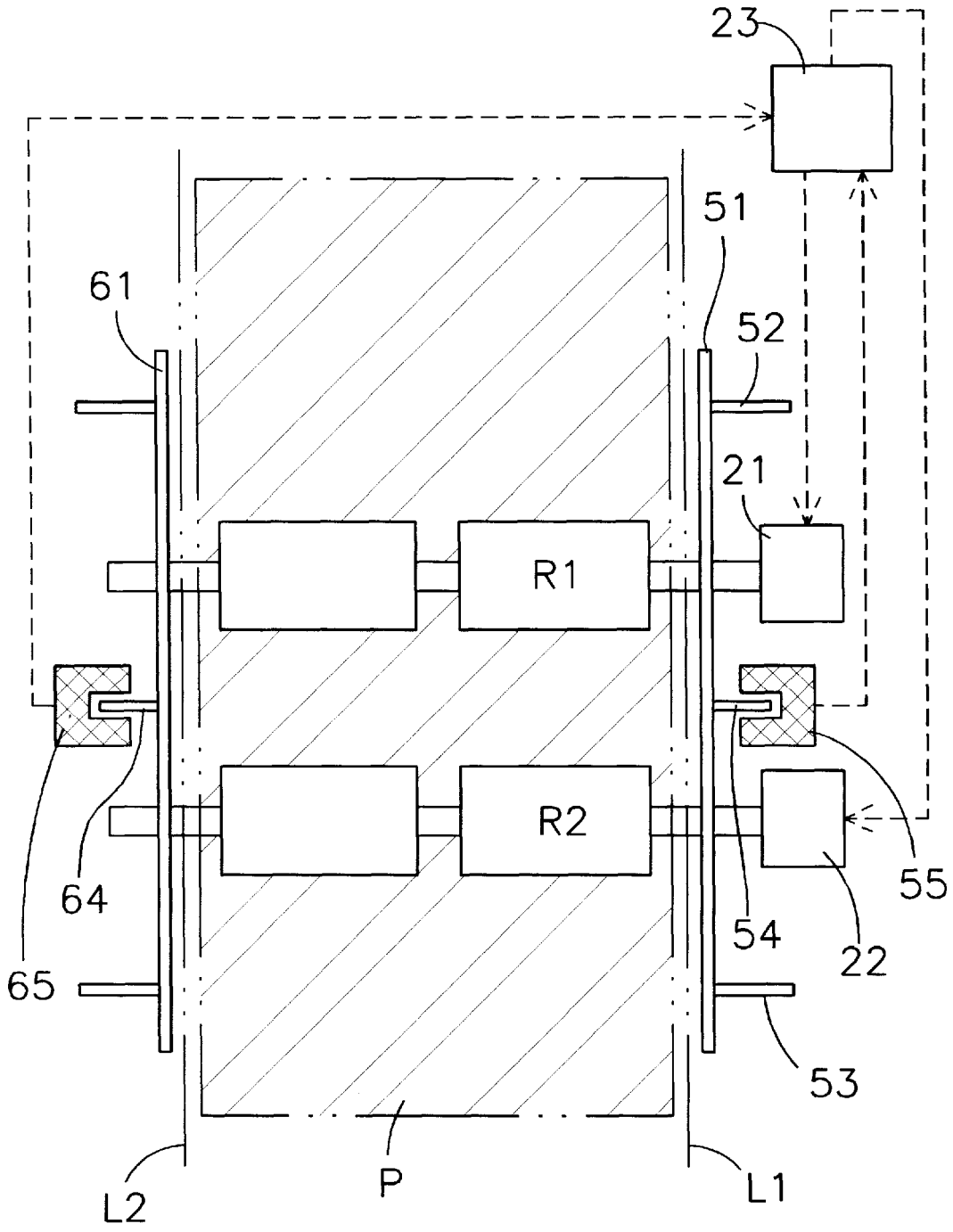
FIG. 3A is a schematic top view showing the structure of the sheet jamming-proof mechanism for paper-feeding system according to the first embodiment of the invention.
Figure 3B:
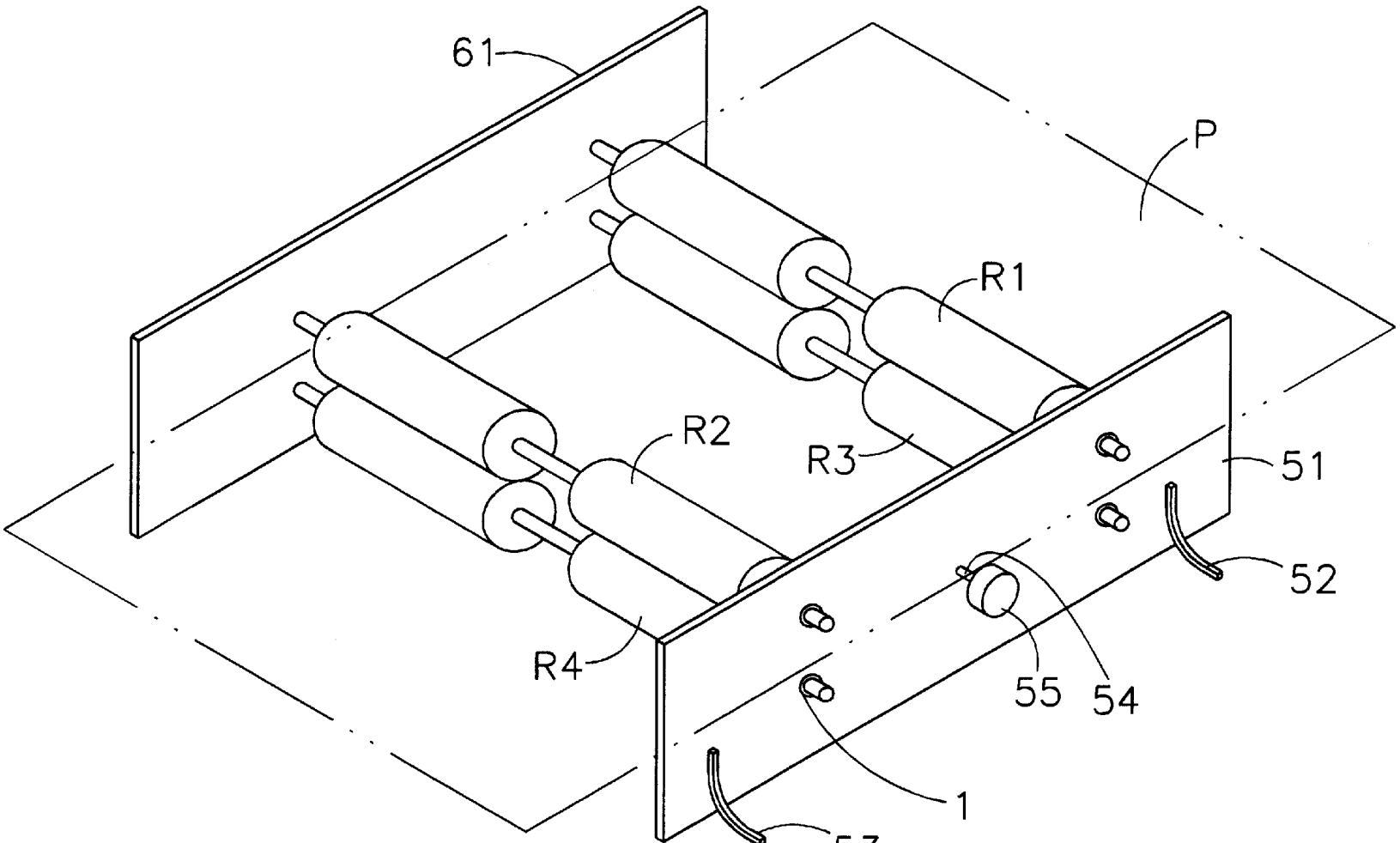
FIG. 3B schematically shows the perspective view of the partial structure of the sheet jamming-proof mechanism for paper-feeding system according to the invention as shown in FIG. 3A.

Referring now to FIG. 3A and 3B, the sheet jamming-proof mechanism for paper-feeding system according to the first embodiment of the invention is provided outside of a left boundary L2 and a right boundary L1 of a predetermined paper-feeding pathway to supervise whether the paper-feeding direction is normal or not. When the paper-feeding direction is abnormal, the sheet jamming-proof mechanism controls the driving mechanisms 21 and 22 of the paper-feeding mechanism (such as the rollers as illustrated in the FIGS.) R1, R2, R3, and R4 to alter the ordinary paper-feeding operation of paper-feeding mechanism (rollers) R1, R2, R3, and R4 by for preventing sheet jamming. As shown in FIGS. 3A and 3B, the sheet jamming-proof mechanism for paper-feeding system according to the first embodiment mainly comprises: a left touch plate 61 and a right touch plate 51; a plurality of detectors 65 and 55; and a controller 23 for controlling whether to rotate or to stop the driving device 21 and 22 and the rotation direction thereof. The detectors 65 or 55 may be of, for example, light chopping type. Namely, the detector includes a light emitter adapted to emit a light signal and a light receiver adapted to receive the light signal emitted from the light emitter.

Each one of touch plates 61 and 51 is closely contiguous to the left boundary L2 and right boundary L1 of paper-feeding pathway and is elastically hold by supporting element 52 and 53 on the frame (FIGS. 3A, 3B, 4A, and 4B). Besides, protruding from the touch plate 61 toward the detector 65 is a projection 64 capable of being inserted into the detector 65. The function of the projection 64 will be described in detail below. Similarly, a projection 54, corresponding to the detector 55, is also provided on the touch plate 51.

Figure 4A:
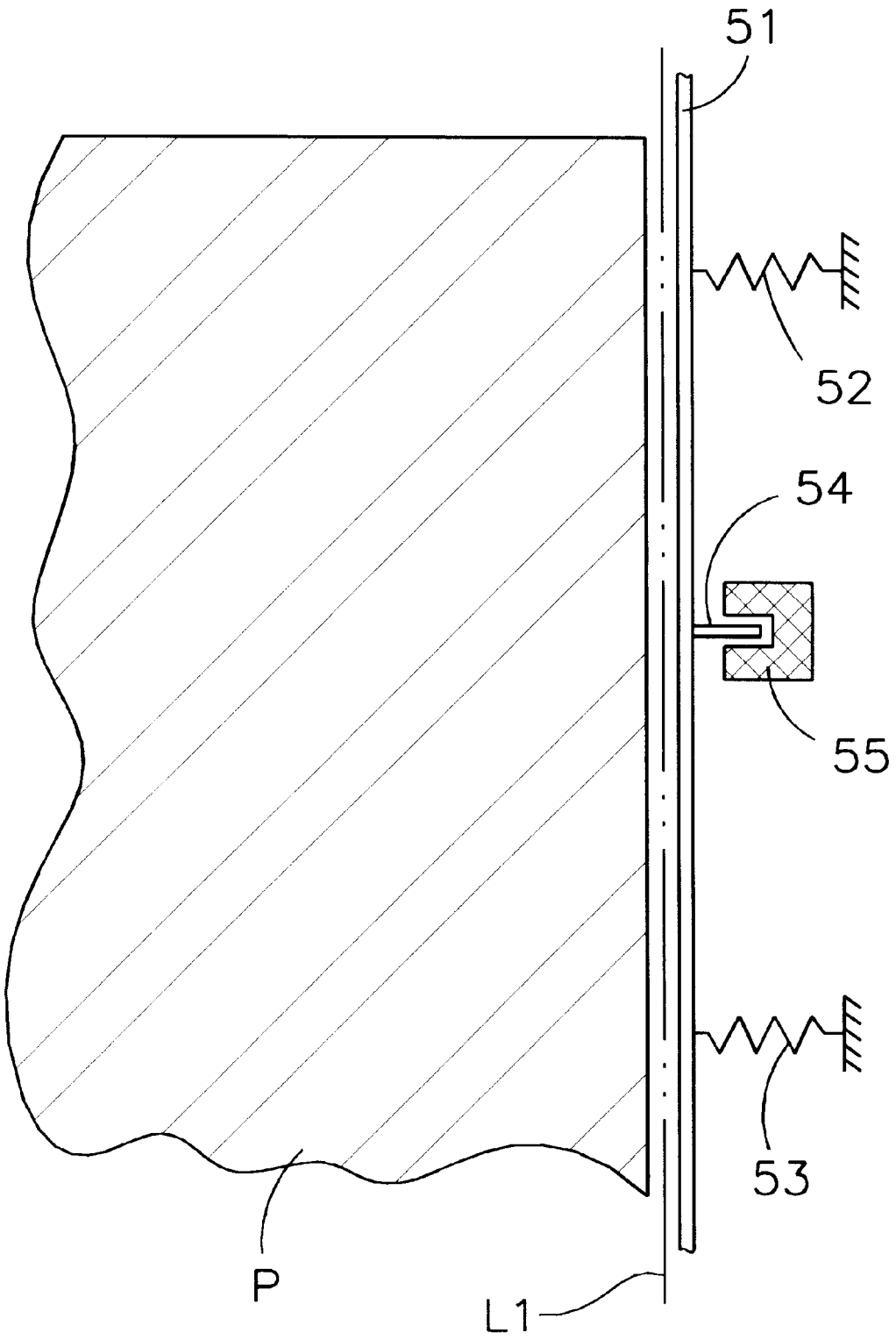
FIG. 4A is a partial enlarged view of FIG. 3A showing a state in which the paper-feeding direction is normal.
Figure 4B:
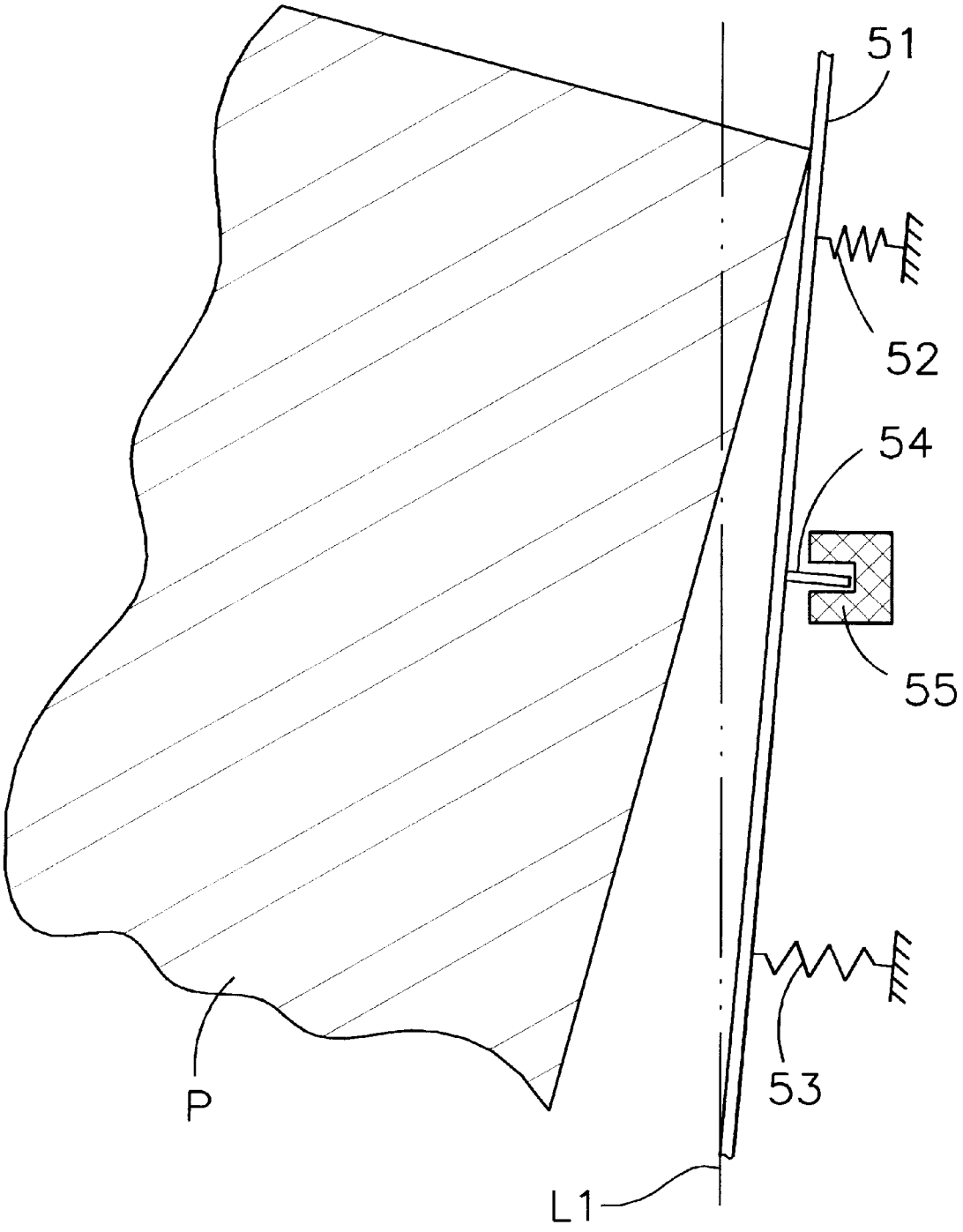
FIG. 4B, similar to FIG. 4A, is another partial enlarged view showing a state in which the paper-feeding direction is deviated.

When the paper-feeding direction is correct, as shown in FIG. 4A, the edge of a paper P being fed does not contact with the touch plates 61 and 51. Therefore, the touch plates 61 and 51 stay in their original sites, the supporting elements 52 and 53 are not compressed, and no signals indicating the insertion of projection 64 and 54 are detected by the detectors 65 and 55. On the other hand, when the paper-feeding direction is deviated, as shown in FIG. 4B, the touch plate 61 (or 51) is pushed by the edge of paper P, therefore, touch plate 61 (or 51) deviates from the original site and supporting elements 52 and 53 are compressed. The projection 64 (or 54) inserts into the detector 65 (or 55) to chop the light signal emitted from its light emitter. Thus, the detector 65 (or 55) detects the shift of the touch plate 61 (or 51) that indicating the deviation of paper-feeding direction and sends a signal to the controller 23 (see FIG. 3A). The controller 23 controls the driving mechanisms 21 and 22 of paper-feeding mechanism rollers R1, R2, R3, and R4 to stop rotating or to alter their direction for preventing sheet jamming.

Figure 5A:
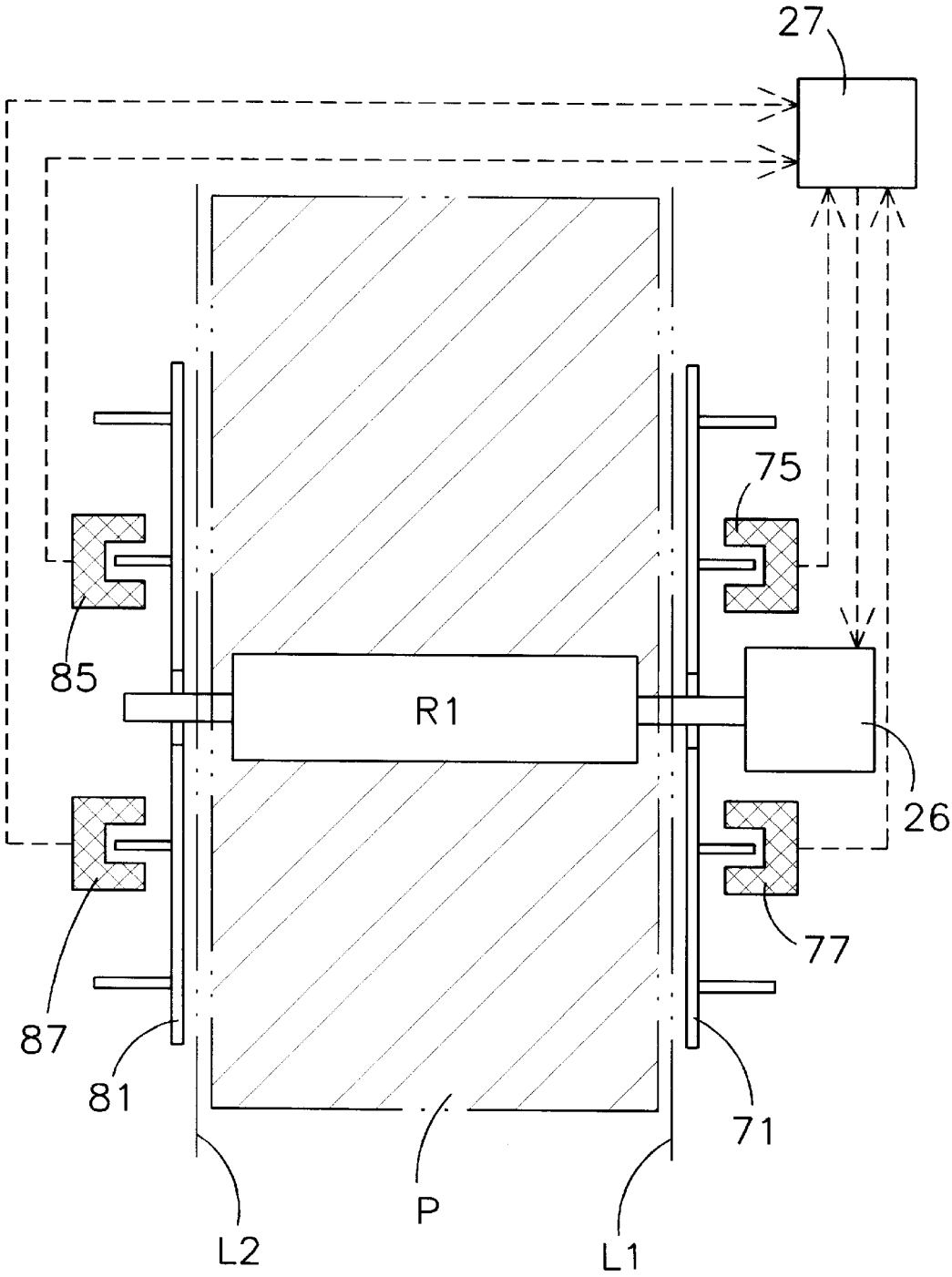
FIG. 5A is a schematic top view showing the structure of the sheet jamming-proof mechanism for paper-feeding system according to the second embodiment of the invention.
Figure 5B:
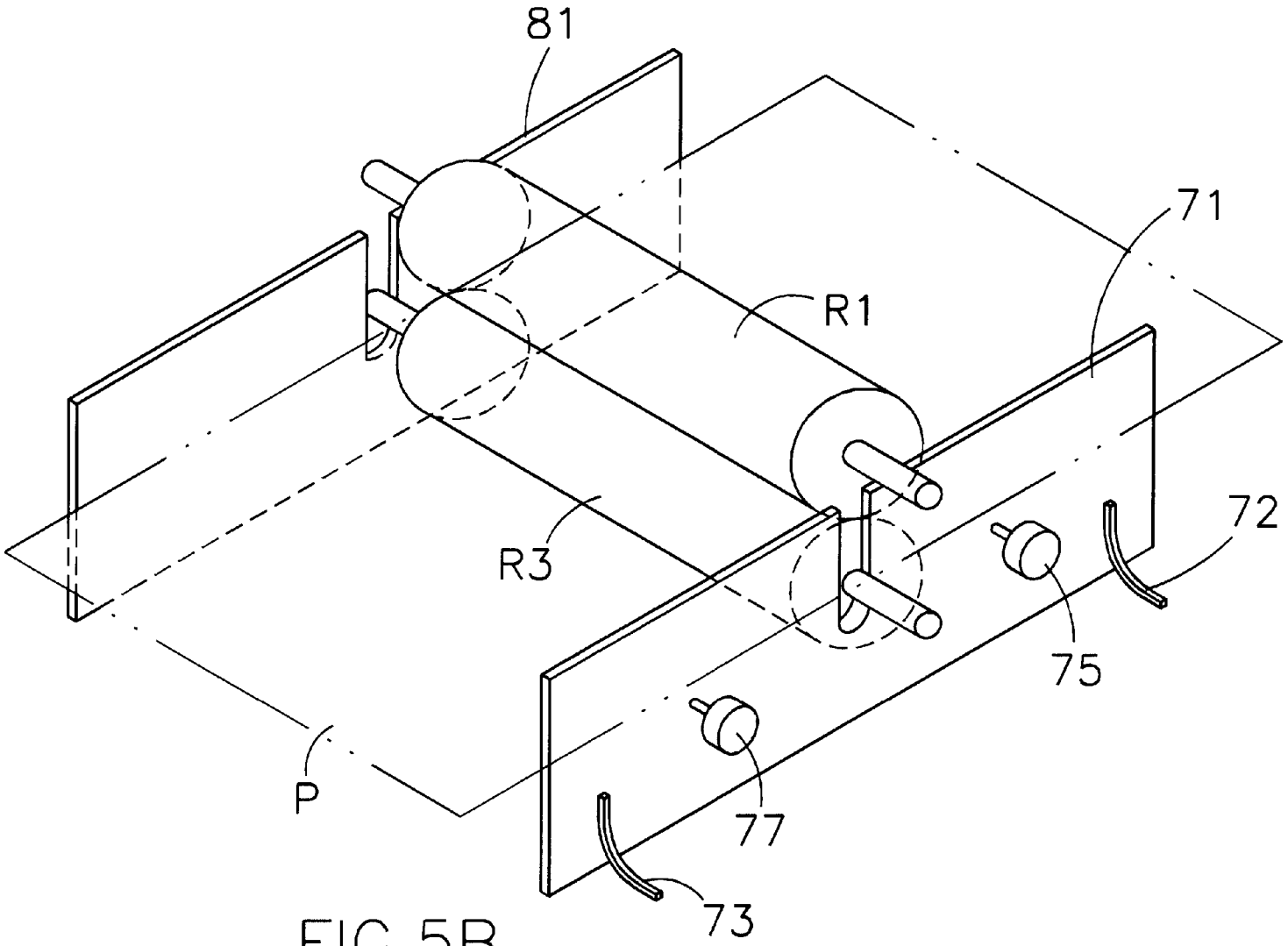
FIG. 5B is a perspective view of the partial structure of the sheet jamming-proof mechanism for paper-feeding system as shown in FIG. 5A.

Referring to FIG. 5A and 5B, the main difference between the sheet jamming-proof mechanism for paper-feeding system of the second embodiment and the aforesaid sheet jamming-proof mechanism of the first embodiment is that the numbers of their detectors are different. Detectors 77 and 75 are installed outside of a touch plate 71 and, respectively, on the upstream side and the downstream side in the paper-feeding direction. Similarly, detectors 87 and 85 are installed outside of a touch plate 81 and, respectively, on the upstream side and the downstream side in the paper-feeding direction. As the right-hand side detector 77, 75 or the left-hand side detector 87, 85 detects the shift of the touch plate 71 or 81 that indicates the deviation of paper-feeding direction, the detector issues a signal to inform a controller 27. The controller 27 controls a driving device 26 of the paper-feeding mechanism(roller) R1 and R3 to stop the rotation or alter the direction of the roller R1 and R3 for preventing sheet jamming. Because of the increasing detector number, the sensitivity of the sheet jamming-proof mechanism according to the second embodiment is better than that according to the first embodiment.

Though in the aforesaid preferred embodiments, paper-feeding system have been described with regard to image scanners, this invention may as well be applied to any other suitable machines having paper-feeding system. Additionally, though light chopping type detectors are used for the detectors in the foregoing embodiments, the detectors may also be microswitch type detectors or light reflective type detectors. While the invention has been described by the embodiments, it is to be understood that the invention is not limited to the disclosed examples. On the contrary, it is intended to cover various modifications and similar applications included within the spirit and the scope of the appended claims. Therefore, the scope of the appended claims should be accorded the broadest interpretation so as to encompass all such modifications and similar arrangements.

I claim:

1. A sheet jamming-proof mechanism for a paper feeding system having paper boundaries delimited along a predetermined paper-feeding pathway, said sheet jamming-proof mechanism comprising:

at least one resiliently mounted touch plate arranged closely contiguous to the side boundary of the paper-feeding pathway, said touch plate being forced to shift only when pressed by a sheet which has deviated from the paper feeding pathway; and at least one detector for sensing a shift in said touch plate.

2. A sheet jamming-proof mechanism for a paper feeding system as described in claim 1, wherein each detector is located in the vicinity of said touch plate.

3. A sheet jamming-proof mechanism for a paper feeding system as described in claim 1, further comprising:

a controller adapted to control a driving device of the paper feeding system to alter an ordinary paper-feeding action when a shift in any one of said touch plates is sensed by a detector.

4. A sheet jamming-proof mechanism for a paper feeding system as described in claim 3, wherein said controller controls the driving device to stop or reverse the paper-feeding action of the paper-feeding when a shift in any one of said touch plates is sensed by said detector.

5. A sheet jamming-proof mechanism for a paper feeding system as described in claim 1, wherein said at least one touch plate includes two touch plates, each touch plate located closely contiguous to opposite side boundaries of the paper-feeding pathway.

6. A sheet jamming-proof mechanism for a paper feeding system as described in claim 1 or 5, wherein each touch plate is operatively associated with two of said detectors for sensing a shift in said touch plate.

7. A sheet jamming-proof mechanism for a paper feeding system as described in claim 1, wherein each detector is a light chopping type detector.

8. A sheet jamming-proof mechanism for a paper feeding system as described in claim 1, wherein each detector is a microswitch type detector.

9. A sheet jamming-proof mechanism for a paper feeding system as described in claim 1, wherein each detector is a light reflective type detectors.

10. A sheet jamming-proof mechanism for a paper feeding system as described in claims 1 or 5 wherein each touch plate is arranged substantially parallel to a side boundary of the paper-feeding pathway.

* * * * *